United States Patent [19]

Martin

[11] 4,321,597

[45] Mar. 23, 1982

[54] EXPANDED CHARACTER GENERATOR

[75] Inventor: Joel T. Martin, Melbourne, Fla.

[73] Assignee: Documation Incorporated, Melbourne, Fla.

[21] Appl. No.: 171,172

[22] Filed: Jul. 22, 1980

[51] Int. Cl.[3] ..... G09G 1/08

[52] U.S. Cl. ..... 340/724; 315/367; 315/410; 340/731; 340/739; 340/744; 340/799

[58] Field of Search ..... 315/367, 394, 410; 340/731, 739, 744, 745, 724

[56] References Cited

U.S. PATENT DOCUMENTS

| | | | |
|---|---|---|---|
| 2,052,183 | 8/1936 | Lewis et al. | 315/410 X |
| 3,011,164 | 11/1961 | Gerhardt | 340/731 X |
| 3,020,530 | 2/1962 | Volberg | 340/731 X |
| 3,437,869 | 4/1969 | Cobb et al. | 315/367 |
| 3,999,168 | 12/1976 | Findley et al. | 340/731 X |
| 4,205,309 | 5/1980 | Music | 340/731 X |

*Primary Examiner*—David L. Trafton
*Attorney, Agent, or Firm*—Duckworth, Allen, Dyer & Pettis

[57] ABSTRACT

A cursive writing type cathode ray tube (CRT) display system in which the vertical size of the characters are increased by an input command from a keyboard and central processing unit (CPU). The CRT has both electrostatic and magnetic deflection systems with the magnetic deflection producing a raster in which each horizontal scan is electrostatically deflected to write characters on the screen. The characters are formed from stored digital codes selected by commands from the CPU. Digital to analog (D/A) converters produce analog deflection signals to produce a set of multiple strokes to form a character and to produce analog voltages for controlling the brightness of the stroke. Digital commands from the CPU are generated to increase or decrease the magnitudes of the various analog signals from the D/A converters when changing the vertical character size. Full page or partial page displays may be produced in which the number of horizontal scan lines for the partial page display is reduced over that for the full page display and the vertical character heights are proportionately increased. The system also may provide either 10 or 12 pitch characters on command from the CPU as well as superscripts and subscripts.

11 Claims, 10 Drawing Figures

| STROKE NO. | X | Y | Z |
|---|---|---|---|
| 1 | +3 | 0 | 0 |
| 2 | +3 | +1 | H |
| 3 | 0 | +2 | M |
| 4 | -2 | +1 | H |
| 5 | -2 | 0 | M |
| 6 | -1 | +2 | H |
| 7 | +3 | +1 | H |
| 8 | +3 | -1 | H |
| 9 | -1 | -2 | H |
| 10 | -2 | 0 | 0 |
| 11 | -2 | -1 | H |
| 12 | 0 | -2 | M |
| 13 | +3 | -1 | H |
| 14 | +3 | -3 | 0 |
| 15 | -3 | -2 | 0 |
| 16 | -3 | -1 | 0 |

EXPANDED CHARACTER GENERATOR

BACKGROUND OF THE INVENTION

1. Field of the Invention

The present invention relates to cursive writing type word processing systems and particularly to a system that provides for increasing the size of the characters on a display and for changing the pitch of a line of characters.

2. Description of the Prior Art

Electronic word processing systems commonly utilize a keyboard and magnetic tape and card reader inputs. A cathode ray tube screen is generally provided with characters entered into the system appearing on the screen. The characters are generated in some systems digitally utilizing a matrix of dots or the like. Such characters are often difficult to read because of their discontinuous nature. Therefore, another type of character display is utilized in the cursive writing type word processing systems. Here the electron beam of the cathode ray tube is scanned to form a raster with one raster line for each character line. Typically, magnetic deflection circuits are utilized to produce the scanning raster. The beam may then be deflected by an electrostatic deflection system so as to cause characters to be written on the screen as sequences of short continuous lines. While the operation and control of such systems may be through well known digital processing techniques, digitally coded characters will have their information converted to analog signals to drive the deflection system. Similarly, analog signals are applied to the brightness control electrodes of the cathode ray tube to permit blanking of the screen when necessary and to vary the brightness of individual strokes of the cursive letters to maintain even brightness of each character. An example of a cursive character generator may be found in U.S. Pat. No. 4,205,309 to Music and assigned to Documation Incorporated.

Many users consider that the cursive written characters are more easily read than digitally generated characters. However, in any case, the ease of reading is a function of the size of the cathode ray display screen. For cost and convenience reasons, relatively small size screens are highly desirable. Particularly with small screens, a full type written page with, for example, 64 lines, results in relatively small characters. It is therefore desirable to be able to selectively expand the character sizes to improve readability and to minimize eyestrain on the part of the operator when editing and reviewing information in the system. When using a purely digital character generation method, expansion is easily accomplished simply by changing the gain in the deflection circuits. However, in the cursive writing systems, changes in the scanning deflection circuits will result in an increase in writing rate necessary, and will therefore require correction in the brightness of individual strokes and other compensation inherent in the digital to analog conversion circuits necessarily used.

SUMMARY OF THE INVENTION

This invention provides a novel cursive writing type word processing system in which the vertical size of the characters may be increased instantaneously by an input command such as from the keyboard input. A typical cursive writing type word processing system which may utilize the present invention may consist of a keyboard for word and character input, a visual display of the input words in their normal relationship, a microprocessor with program and display memory for processing the words and characters, a printer for outputting hard copy, and permanent information storage, and program input devices such as floppy discs and magnetic card readers. The word processing capability of such a system is controlled by the system software which may consist of sequences of instructions which are executed by the microprocessor as requested by the operator through the keyboard. Instructions may be stored on discs or cards which permits ease of expansion of the capability of the system.

In accordance with the invention, such a system may provide means for increasing the size of the characters on the display unit instantaneously in response to a command from the keyboard input. For example, during the process of editing text, the operator may instruct the system to double the vertical size of the characters by calling for a half page display to fill the viewing screen. This feature permits ease of reading, prevents eyestrain and minimizes errors. Other commands may be provided to scroll the text or to select particular portions of the page.

The system utilizes a cathode ray tube (CRT) having both electrostatic and magnetic deflection systems. The magnetic deflection yoke causes the electron beam to be deflected vertically from top to bottom at, for example, a 60 times per second rate. During each vertical scan, the horizontal deflection circuit causes the electron beam to scan from left to right at, for example, 66 times per vertical scan. Each horizontal scan represents one character line. During each of the horizontal scans, the electrostatic deflection system is used to cause the beam to be slightly deflected so as to write characters on the screen. The intensity of the electron beam during the character writing process is controlled by video information to the cathode of the CRT. This permits the necessary variation in intensity to ensure even brightness of characters and to provide blanking between characters.

The individual characters are written on the screen as a succession of short strokes, for example, 16 strokes may be utilized to define a character and a 17th stroke time provided for character spacing. Each character is defined by a microprogram stored in a read only memory (PROM). 16 8-bit bytes may be stored for each character. Each 8-bit byte therefore will define the magnitude of required deflection potential, the polarity of the deflection potential, and the intensity of the electron beam for that stroke.

In addition to the provision of full or partial page displays, the invention advantageously provides a multiple choice of pitch; that is, the number of characters per line. For example, a typical system will provide for selection of either 80 or 96 characters per line with the 80 character line designated as 10 pitch and the 96 character line as 12 pitch. A horizontal scan of 66 lines for one vertical scan permits a full printed page of 64 lines to be displayed, changing the horizontal scan to 33 lines for one vertical scan will result in a half page mode. Two lines may be allocated for vertical retrace in the full page mode and one line in the half page mode.

Video line and page timing circuits are used to control both the vertical and horizontal magnetic scanning. A vertical sync pulse is produced which may be locked to the power line frequency of 60 Hz if desired and a horizontal sync pulse is generated which will occur at the end of each line of characters to instruct the beam to return to the start of the next line. For a half page display, 33 horizontal scans are used per vertical scan which allows a one line interval per vertical retrace. The horizontal retrace requires 3 or 4 character times for 80 to 96 character lines, respectively. The timing circuits also produce special line sync and page sync pulses which are sent to the display memory in the CPU to synchronize the data sent from the memory. The page sync occurs at the beginning of every page and assures that the first character on the page will be displayed in the upper left hand corner of the screen, and the line sync pulse occurs at the end of each line to instruct the memory with respect to the retrace interval.

The sync pulses are derived from a character clock which is locked to produce a pulse at the end of each character time. Precise oscillators are used, which may be for example crystal controlled, for producing a character clock for the 10 pitch and for the 12 pitch mode of operation. In such case, two oscillators are selectable in accordance with the desired pitch and means are provided for producing a clock at half the frequency of the selected clock frequency. A divide by 17 binary counter may be used to define the individual character stroke addresses and to produce a sequence of character clock pulses at the end of each count. The horizontal sync pulse information is derived from the character clock output of the divider which also has an input from the CPU that determines whether 80 or 96 characters per line are required. The horizontal sync pulse controls the horizontal magnetic deflection circuits used for horizontal scanning. The horizontal sync pulse stream is divided by either 66 or 33 to produce the vertical sync pulse. A logic signal from the CPU selects whether 32 or 64 lines are to be displayed and controls the division of the horizontal sync pulse stream.

As previously mentioned, the character writing is controlled by electrostatic deflection of the cathode ray electron beam and therefore X deflection plates and Y deflection plates are provided in the CRT. When a character is to be written, the address is obtained from the display memory and latched into a data latch during the 17th stroke of the previous character. The digital code from the character microprogram for each stroke, which defines the voltage and polarities applied to the X and Y plates, are fed to an X digital to analog (D/A) converter and a Y D/A converter. Thus, the analog voltage from the X D/A converter is applied to the horizontal plates and the analog voltage from the Y D/A converter is applied to the vertical plates. At the same time, the appropriate code bits drive a video D/A converter which produces an analog voltage to the intensity anode of the CRT. As previously mentioned, the brightness of the screen during a stroke must be controlled. For example, when a long stroke having a high writing rate is required, the intensity must be higher than for a short stroke with a low writing speed if uniformity between each stroke is to be maintained.

It may be understood that when selecting the half page mode it is necessary for the Y deflection magnitude to be increased by a factor of two. However, since the time available to produce this increased magnitude is also increased by a factor of two, no major change in the actual D/A converter circuits are necessary except for a slight trimming controlled by the half page mode logic level from the CPU.

The X deflection magnitude required during the half page mode does not change from the full page mode since the same number of characters per line is to be produced. Twice as much time is available to produce an X stroke and the width of the characters or length of the X stroke is to be unchanged in both full and half page modes. Therefore, the magnitude of the applied potentials must be reduced by a factor of two. The logic signal from the CPU for the half page mode thus controls the X D/A converter to cause this reduction in X deflection voltages. The video D/A converter controls the brightness of the display for each character stroke as previously described. It also receives control signals from the CPU in response to keyboard inputs which can advantageously provide other functions. For example, certain characters or words can be made to blink on the screen by providing a pulse sequence which will cut off the beam periodically. Another feature is a half brightness input to reduce the intensity of certain characters such as for forms or other graphic lines on the screen. Blanking of the screen during both vertical and horizontal retrace intervals is also controlled by the video D/A converter.

The position of a character on the screen for a particular horizontal line is a function of the potentials applied to the electrostatic deflection plates. Where a subscript or superscript is required, this is provided by an appropriate constant bias applied to the Y plates during the writing of the character. Such bias is also generated by a D/A converter responsive to appropriate logic signals from the CPU.

The present invention is an improvement on the character generator disclosed in previously mentioned U.S. Pat. No. 4,205,309 which is hereby incorporated by reference to provide additional details to the following detailed description of the invention.

As may now be seen, a principal object of the invention is to provide, in a cursive writing word processing system, the capability of switching from a full page display to a partial page display.

It is another object of the invention to provide in such a system, the capability of switching between a full page display and a partial page display by means of a keyboard input command.

It is yet another object of the invention to provide circuits for controlling the character writing potentials automatically to prevent distortion either in brightness or in form of characters when changing between a full page and a partial page display.

It is yet another object of the invention to provide storage of digital cursive character information and for means to convert such digital information to analog signals for control of an electrostatic deflection system to thereby write a selected character.

It is a further object of the invention to provide digital control means for controlling horizontal and vertical scanning circuits to permit switching between partial page and full page video presentations without distortion of the displayed characters.

It is still a further object of the invention to provide means for selecting a desired character pitch in a cursive writing word processing display.

It is yet a further object of the invention to provide digital means for controlling the character pitch of such system by means of a keyboard entered command.

It is another object of the invention to control the horizontal scan and retrace time in the system in accordance with the selected character pitch.

It is a further object of the invention to provide, in a cursive writing type word processing system, means for instantaneously increasing the legibility of the display during editing and the like for reducing eyestrain on the part of the operator by at least doubling the height of the cursive written characters without increasing their width and without distortion thereof.

These and other objects and advantages of the invention may be understood from the following detailed description when read in light of the drawings.

DESCRIPTION OF THE PREFERRED EMBODIMENT

Figure 1:
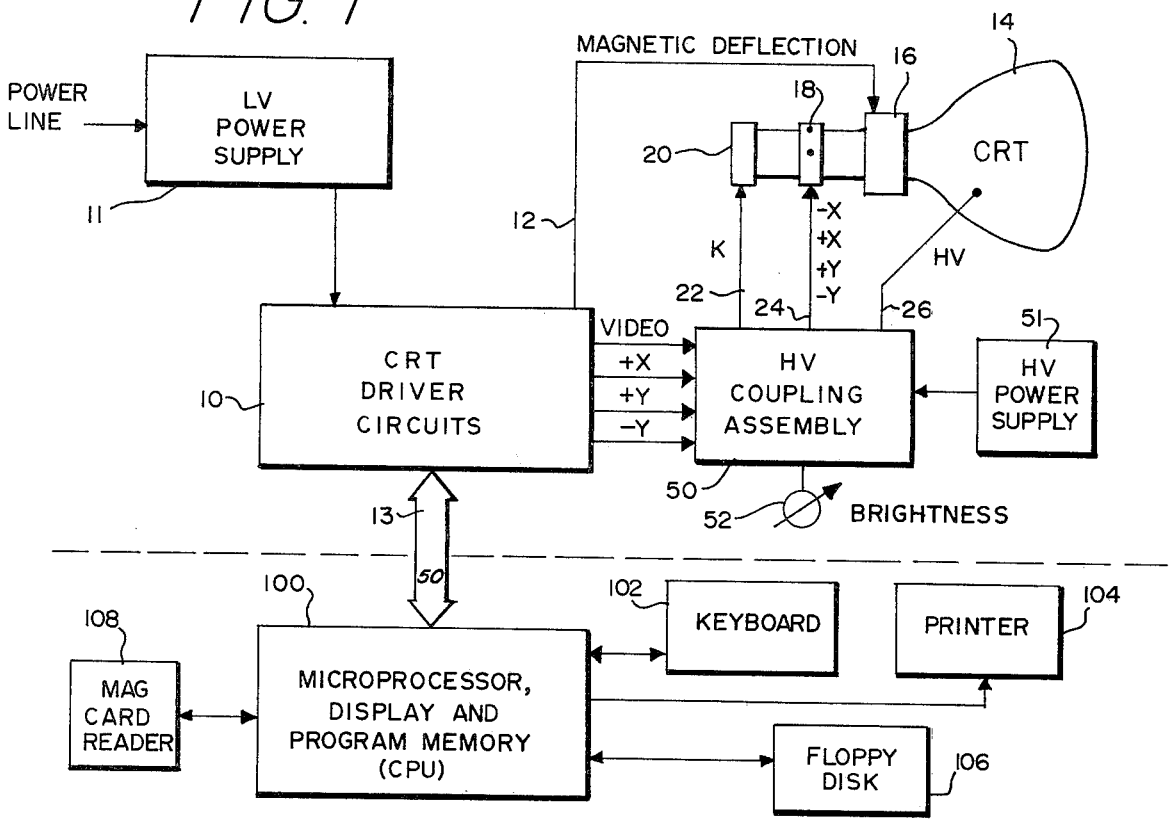
FIG. 1 is a simplified block diagram of a typical cursive writing type word processing system.

Before describing the character size control system of the invention, a general description of a word processing system to which the invention is particularly applicable will be presented. Referring to FIG. 1, a greatly simplified block diagram is shown for a cursive writing type word processing system. There are two basic portions of the system: the input and control circuits shown below the dashed line and the cathode ray tube (CRT) circuits shown above the dashed line.

In the illustrated cursive writing system, a cathode ray tube 14 is utilized as a visual display to permit the operator to view the characters being processed. CRT 14 utilizes both magnetic and electrostatic deflection. Yoke 16 is provided for magnetic deflection. In addition, deflection plates 18 are used to deflect the beam electrostatically. Cathode assembly 20 permits control of the brightness of the displayed characters by signals on lead 22. CRT driver circuits 10 provide the magnetic and electrostatic deflection signals for controlling the beam of CRT 14. It is necessary to operate CRT 14 with a high anode voltage, for example, 15,000 volts, which is supplied by high voltage power supply 51 via lead 26 to CRT 14. High voltage coupling assembly 50 is interposed between CRT driver circuits 10 and CRT 14 since it is necessary to operate deflection plates 18 at high potential. High voltage coupling capacitors are therefore utilized in assembly 50 to pass the deflection signals and to isolate the low voltage CRT driver circuits from the high voltages required by CRT 14. A brightness control 52, connected to high voltage coupling assembly 50, permits the overall brightness of the display to be adjusted by the operator. Low voltage power supply 11 provides the operating potentials for CRT driver circuits 10.

As will be discussed below, magnetic deflection yoke 16 is driven from vertical and horizontal deflection circuits in CRT driver circuits 10. The beam is deflected vertically from top to bottom at a 60 cycle second rate. During each vertical scan, horizontal deflection circuits cause the beam to scan from left to right at 66 times per vertical scan for normal operation of the system. During a single horizontal scan, voltages are applied via lead 24 to the deflection plates 18 which comprise a pair of X axis plates representing a horizontal axis and a pair of Y axis plates representing a vertical axis. The voltages thus applied cause the beam to be deflected from its normal horizontal path in such a manner as to write characters on the screen. During the scan and during the writing process, the intensity of the electron beam is controlled by video information from CRT driver circuits 10 via lead 22 to cathode assembly 20. As may be now understood, a line of characters may be written across the face of CRT 14 for each horizontal scan of the electron beam. The vertical scan then permits successive lines to be written. Allowing two horizontal scan lines for vertical retrace, it may be noted that in the normal operation, 64 lines may be written on the CRT 14 face. This operation will be referred to as producing a full page display.

The full page display permits the operator to visualize the entire page; however, the height of each character may be relatively small for a typical CRT 14. During editing of a text displayed on the screen, it is desirable that the characters be enlarged for ease in reading and editing, and to relieve eyestrain for the operator. Therefore, the present invention includes means for displaying a half page of 32 lines expanded over the entire face of the tube. Thus, each character is seen at about twice the height of the characters in the full page display.

The control of the displayed information is effected by a central processing unit (CPU) 100 connected to the CRT driver circuits 10 by bus 13. CPU 100 includes a microprocessor, and memories for the character display and for the necessary control programs. CPU 100 is normally connected to various input/output devices such as magnetic card reader 108, keyboard 102, printer 104, and floppy disc 106. Keyboard 102 may produce an ASCII output and will have the normal alphabet, numerals and punctuation characters. Additionally, keyboard 102 will include special operation keys to instruct CPU 100 to control various display and editing functions desired. Printer 104 may be controlled to produce hard copy from keyboard 102 or from information stored on magnetic cards or floppy discs. Under control of keyboard 102, text may be displayed on CRT 14 from an input from mag card reader 108, floppy disc 106 or keyboard 102. Additionally, change from full page display to half page display may be controlled by a keyboard command.

In addition to providing the half page expanded character display, the present invention also provides for either 10 pitch, which produces 80 characters per line, or 12 pitch, which produces 96 characters per line. The pitch selection is also made by command from keyboard 102.

Figure 2:
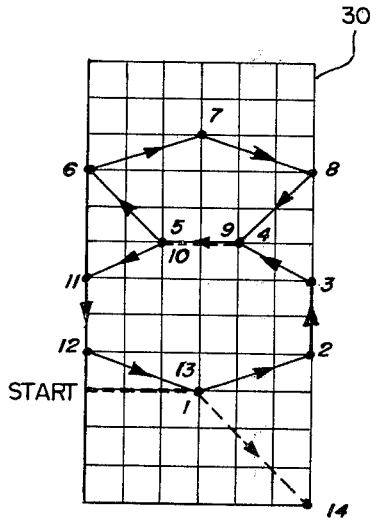
FIG. 2 presents a character matrix for the word processing system of FIG. 1 showing the production of the numeral 8 and a table of information supplied to the CRT during such writing.

As described above, characters are produced on the screen of CRT 14 through a cursive writing technique. Turning now to FIG. 2, the method of producing a typical character will be explained. Each character is written by a sequence of 16 strokes with each stroke produced by selected deflection voltages applied to deflection plates 18 of CRT 14. For the full page display of 96 characters per line, the stroke interval is 148 ns. Each character will require 16 strokes and each stroke is defined by 8 bits of data. Two data bits are utilized to define four possible brightness levels: off, low, medium, or high. Three data bits define the magnitude and polarity of the signals applied to the X deflection plates, and the remaining three bits define the magnitude and polarity of the voltage applied to the Y deflection plates.

As an illustration, the table of FIG. 2 presents a sequence of 16 strokes which will produce the numeral 8 on the screen. The space allocated to a character is a 7×13 point matrix 30. The electron beam at the start of a character is located in the first column at the fourth point from the lower boundary of matrix 30. This point is marked "start" in FIG. 2. For the example given, it may be noted that stroke 1 indicates that voltage is applied to the X deflection plates such as to cause the beam to move from the start position a distance of +3 units, which is defined as in the left to right direction. It may also be noted that the voltage applied to the Y plates is zero, therefore there is no deflection in the Y or vertical direction. The Z column indicates the intensity of the beam during the indicated stroke. In this case, O represents "off" and the beam is moved from the start position 3 points to the 1 position with the beam blanked, causing no indication on the screen. For stroke number 2, it may be noted that the X deflection requires +3 units to the right while the Y deflection is required to be +1 representing one unit up vertically. Thus, this stroke moves from point 1 to point 2 as indicated. Here the Z column indicates H which is maximum intensity of the electron beam and therefore the stroke from 1 to 2 produces a maximum brightness line on the screen. The third stroke indicates zero change horizontally and a +2 change vertically producing the indicated line from point 2 to point 3. Here, the intensity is indicated as medium (M) and therefore the beam intensity is reduced from that of the second stroke. As previously mentioned, the time allocated to each stroke is 148 ns. The distance of the stroke from 1 to 2 is greater than that of stroke 2 to 3 and the velocity of the beam will be higher. Since the beam thus has a higher velocity on stroke 1 to 2, a higher intensity is required to produce essentially the same brightness for stroke 1 as the medium intensity produces for stroke 2 to 3. By following the indicated X and Y deflections, the remainder of the character 8 may be traced on matrix 30. It may be noted also that stroke 5, moving from point 4 to point 5, is done with a medium intensity. As the character is continued, it is necessary to retrace stroke 5 from point 9 to point 10. Therefore, stroke 10 is performed with the intensity of the beam "off" to prevent excessive brightness. For the character illustrated, the outline is completed by stroke 13 which brings the trace back to the stroke 1 point. The remainder of the 16 strokes are performed with the beam off and serve the purpose of producing an average zero deflection for both X and Y axes. This averaging process is required since it is necessary to capacitively couple the deflection signals to isolate the high potential on deflection plates 18 from the low potential drivers in CRT driver circuits 10 as previously mentioned. After completion of the 16th stroke, the 17th stroke of zero intensity returns the beam to the start position for the next character. The time for the 17th stroke produces the proper spacing between characters.

CRT Driver Circuits

Figure 3:
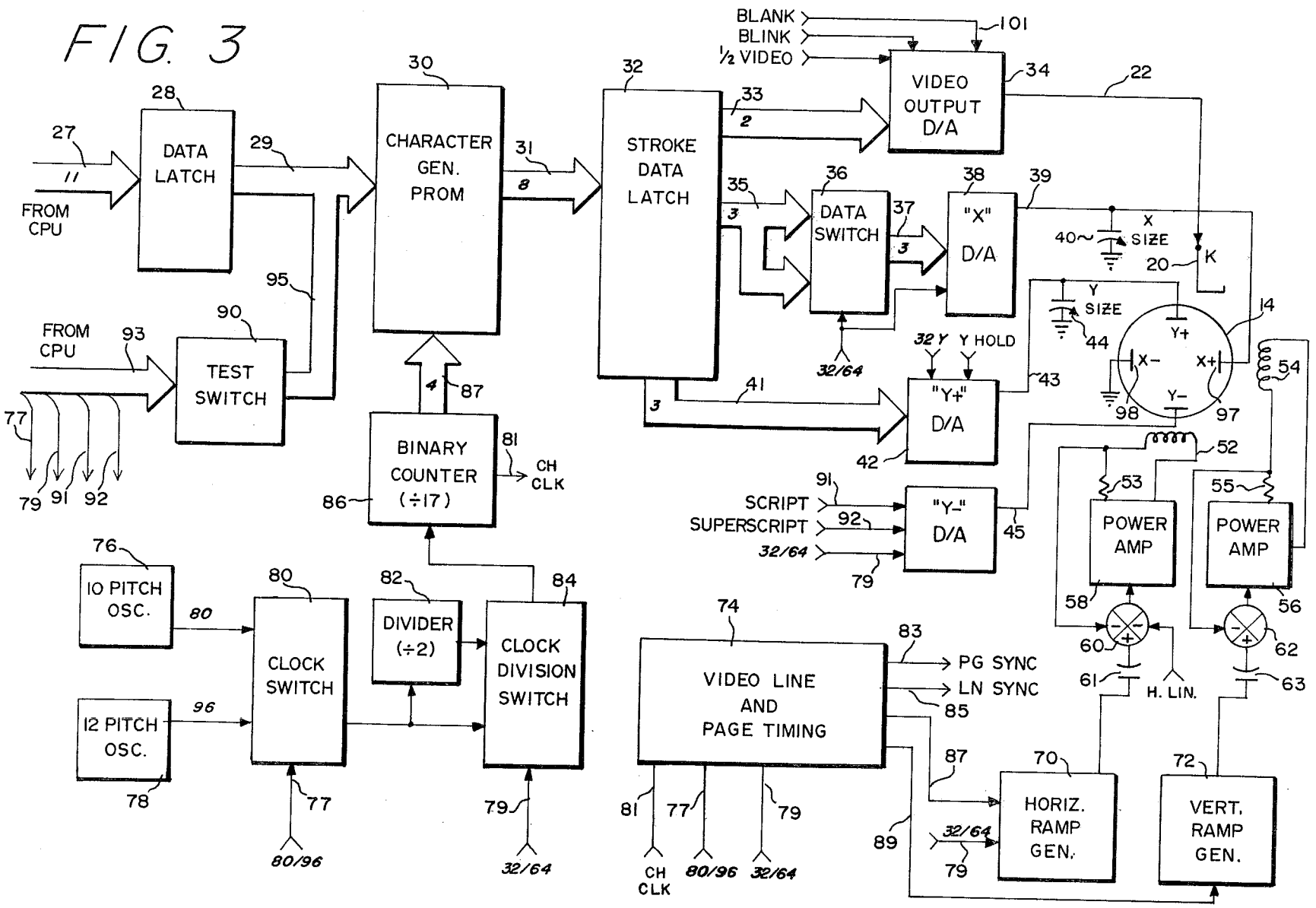
FIG. 3 is a block diagram of the CRT driver circuits of FIG. 1 for a system incorporating the present invention.

Turning now to FIG. 3, a functional block diagram of the CRT driver circuits connected to the cathode ray tube system is shown. This diagram may be considered to be divided into four sections. First, the character clock section is shown comprising oscillator 76 which provides timing for the 10 pitch or 80 character per line operation, and oscillator 78 which provides timing for the 12 pitch or 96 character per line operation. The desired oscillator is selected by clock multiplexers 80 and 84 as will be described. The selected clock drives a binary counter 86 which effectively divides the selected clock rate by 17 to produce a character clock signal pulse on lead 81. A second section is the magnetic deflection system which produces the vertical and horizontal sweeps for the cathode ray tube 14. Line and page timing is provided by circuit 74 which produces a line sync pulse on lead 85 and a page sync pulse on lead 83, both of which are connected back to CPU 100 to define the beginning of a line and a beginning of a page respectively. A character clock pulse on lead 81 is connected to the line and page timing circuits 74. Outputs 87 and 89 from line and page timing circuits 74 control a horizontal ramp generator 70 and a vertical ramp generator 72. These two generators produce linear voltage ramps which are respectively capacitively coupled to horizontal power amplifier 58 and vertical power amplifier 56. The linear ramps are utilized by these power amplifiers to produce a uniformly changing current in the horizontal winding 52 and the vertical winding 54 of yoke 16. Feedback is utilized to maintain linearity. The X and Y deflection voltages which produce the cursive characters, are fed from X digital-to-analog (D/A) converter 38, Y+ D/A converter 42, and Y− D/A converter 46. These converters produce the required analog voltages on the X and Y plates in response to digital signals produced by the character generation section of the system.

The character generation portion of the system comprises a data latch 28 having bus 27 from CPU 100. A command from CPU 100 for a particular character is latched into data latch 28. Bus 29 connects to character generator PROM 30 in which the digital code for each character is stored. As mentioned previously, each character requires 16 8-bit bytes to produce the necessary X and Y deflections of the electron beam. As will be discussed more fully hereinafter, binary counter 86 produces a 4-bit address on bus 87 to character generator PROM 30 which identifies each of the 16 required strokes. The address on bus 29 from data latch 28 identifies the particular character in the memory which is being called for. The code for each 8-bit stroke of the selected character is read out from character generator PROM 30 onto bus 31 to the stroke data latch 32 which holds each set of stroke data during the writing time. The two video level bits are read onto bus 33 to the video D/A converter 34 which produces potentials on lead 22 for off, low, medium, or high intensity as required. The three bits defining the X amplitude and direction are fed from stroke data latch 32 via bus 35 to X D/A converter 38 via data multiplexer (MUX) 36. The output voltage from converter 38 appears on lead 39 and is applied to the +X deflection plate. The opposite or −X plate is grounded. The three data bits defining the Y amplitude and direction is fed to Y+ D/A converter via bus 41. The analog output from converter 42 is connected to the Y+ deflection plate by lead 43.

The Y− deflection plate is connected to Y− D/A converter 46 by lead 45 and is grounded for normal operation. The potential on the Y− deflection plate is modified during certain special operations by converter 46 as will be described in more detail below.

Having hereinabove described the general organization of the CRT driver circuits 10, the various improvements and functions provided by the invention will be described in more detail. In accordance with the invention, it is desired to select, by means of a keyboard input, either a 10 pitch line of characters on the video screen or a 12 pitch line. Accordingly, the 10 pitch oscillator 76 produces a basic sequence of clock pulses which will produce 80 characters per line. Similarly, when a 12 pitch line is required, 12 pitch oscillator 78 produces a sequence of clock pulses which will provide 96 characters per line. To select which oscillator is to be used, clock MUX 80 is provided as controlled via lead 77 from CPU 100. For example, if the operator desires the 96 character per line operation, a logic level representative thereof appears on lead 77 setting clock MUX 80 to pass the clock pulses from 12 pitch oscillator 78 and to block the pulses from 10 pitch oscillator 76. The output of clock MUX 80 is connected directly to clock MUX 84 and to divider 82. Divider 82 may be a flip-flop which produces an output at one half the input rate; in this example, an output at one half of that of 12 pitch oscillator 78. As will be described below, the character clock rate for the full page presentation must be twice that of the half page presentation. Therefore clock MUX 84 is responsive to a logic level on lead 79 from CPU 100 to pass either the original clock pulses from 12 pitch oscillator 78 or the half rate clock pulse stream from divider 82. The logic level on lead 79 will be determined from the keyboard input as to whether the operator desires a full page or half page presentation.

Figure 4:
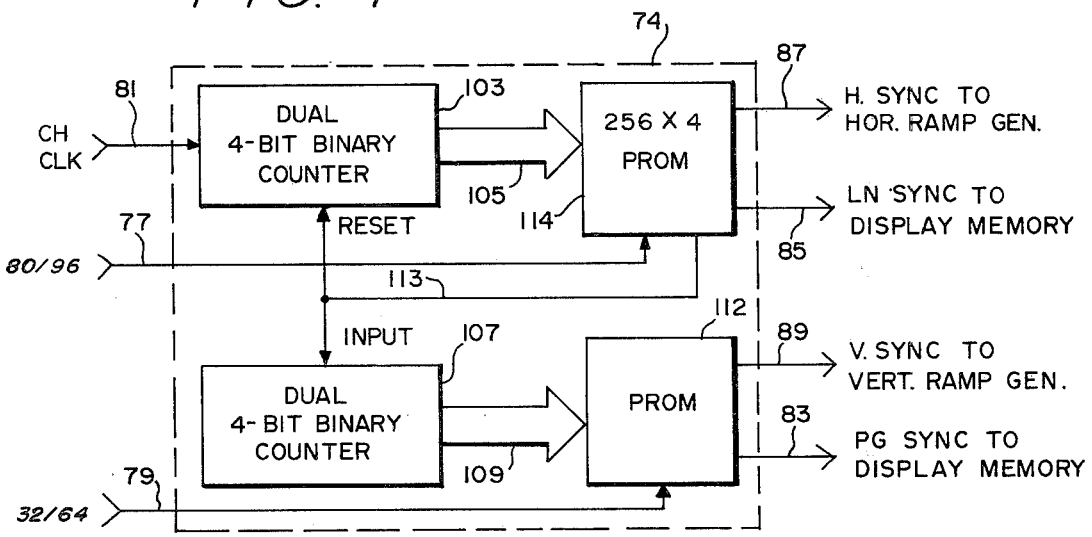
FIG. 4 is a block diagram of the video line and page timing circuits of FIG. 3.

Thus, the selected pitch oscillator clock pulse stream from 84 at its original rate or at half that rate will appear at this output which is connected to binary counter 86. The pulse stream from clock MUX 84 is then connected to binary counter 86 and an output pulse produced at each 17th count. A sequence of these pulses appearing on lead 81 represents the character clock for timing of the deflection circuits and CPU 100. As binary counter 86 produces its count, a 4-bit byte representing each of the first 16 counts are sent to character generator PROM 30 via bus 87. Each byte represents the lower 4 bits of address for each character stroke as shown in the table of FIG. 2. Thus, the first 16 counts select the 16 X, Y, and Z codes called for by the addresses from data latch 28, and the 17th count causes a character space to occur. The CRT 14 beam is blanked during a character space by a signal on lead 101 from CPU 100 to the video D/A converter 22. The video line and page timing circuits 74 are shown in more detail in block diagram of FIG. 4. The horizontal magnetic deflection circuit elements of the figure include dual 4-bit binary counter 103 and PROM 114. Lead 81 from binary counter 86 of FIG. 3 previously described is connected to an input counter 103. The outputs from counter 103 are connected by bus 105 to 256×4 PROM 114 as address lines. Another address line to PROM 114 is the logic level which selects 80 or 96 characters per line appearing on lead 77 from CPU 100. PROM 114 is programmed to produce a sequence of horizontal sync pulses on output lead 87 which control horizontal ramp generator 70 of FIG. 3. PROM 114 also generates line sync (LN SYNC) signal on lead 85 which is connected to the display memory. The incoming character clock on lead 81 is divided by 83 for the 10 pitch mode and by 100 for the 12 pitch mode, allowing three character times for retrace for 10 pitch and four character times for 12 pitch. A PROM output on lead 113 resets counter 103 at the end of each line.

A second dual 4-bit binary counter 107 receives the reset pulse on lead 113 as its input. This reset pulse appears once for each horizontal line. The counter 107 output is applied to a second PROM 112 which divides by 66 or 33 as determined by the logic level on lead 79, indicative of a 32 or 64 line display. PROM 112 produces a vertical sync pulse on lead 89 to control vertical ramp generator 72 of FIG. 3 and a page sync (PG SYNC) signal on lead 83 which is fed to the display memory in CPU 100.

Figure 5:
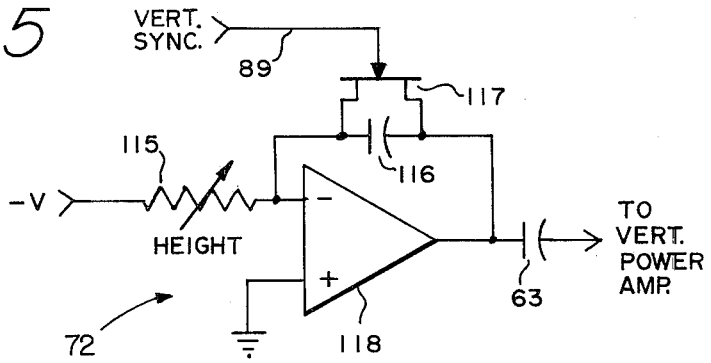
FIG. 5 is a simplified schematic diagram of the vertical ramp generator of FIG. 3.

It is necessary that the spacing between lines of characters over the entire height of the screen be uniform. This requires that the current through the vertical yoke coil 54 in FIG. 3 be linear. At the end of each vertical scan, the current must be quickly returned to its original value and this action is accomplished by the vertical retrace initiated by the vertical sync pulse from PROM 112 of FIG. 4. It is also essential to maintain the average dc current through the vertical deflection winding at zero to prevent saturation of the yoke material which would produce distortion. To accomplish the above requirements, the vertical voltage ramp generator 72 shown in FIG. 5 is utilized. Operational amplifier 118 is driven from a negative voltage source via height control potentiometer 115. Capacitor 116 in a feedback connection around operational amplifier 118 will therefore charge linearly from the negative voltage source, −V. Thus, a linear voltage ramp is generated at the output of amplifier 118 which is capacitively coupled via capacitor 63 to the vertical power amplifier circuits. An FET is connected in parallel with capacitor 116 so as to discharge capacitor 116 during the retrace interval. Vertical sync via lead 89 is applied to the control gate of FET 117 to effectively cause short circuiting of capacitor 116 during retrace. The rate of charge of capacitor 116, which determines the slope of the ramp voltage, is controlled by potentiometer 115 to vary the height of the display on cathode ray tube 14.

Referring to FIG. 3, it may be noted that the voltage ramp from vertical ramp generator 72 is coupled via capacitor 63 to a comparator network 62 and to power amplifier 56. In order to maintain the output current from power amplifier 56 through vertical deflection coil 54 in a linear or uniformly increasing fashion, current feedback resistor 55 is used to produce a feedback voltage to comparator network 62.

It is to be noted that the vertical deflection circuit is not affected by changing from full page to half page display since the vertical scan requires the same period of time in either case.

Figure 6:
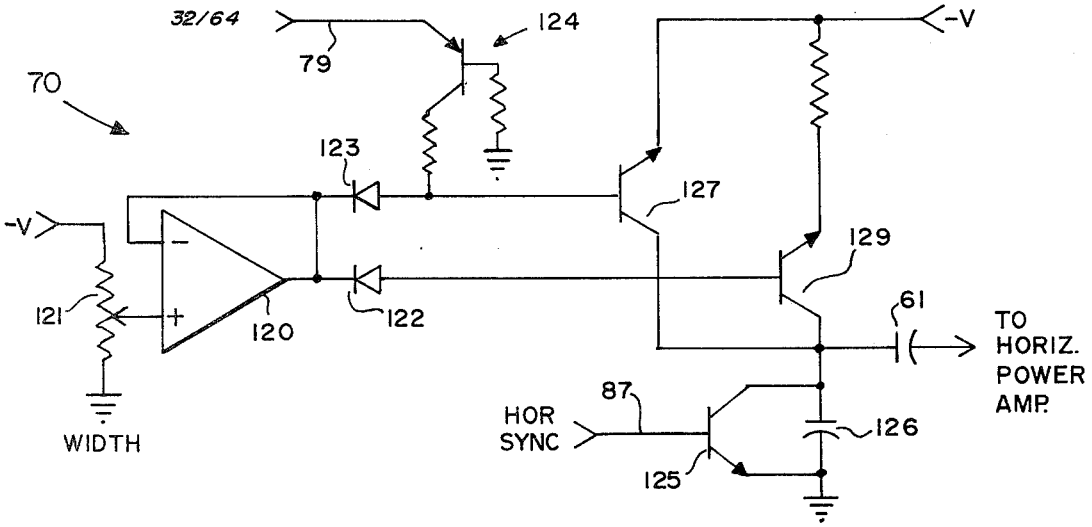
FIG. 6 is a simplified schematic diagram of the horizontal ramp generator of FIG. 3.

The horizontal magnetic deflection circuit operates at either 66 or 33 times the frequency of the vertical deflection circuit depending on whether operation is in the full page or half page mode. FIG. 6 shows a simplified schematic of horizontal ramp generator 70 controlled by CPU 100 to operate in the full page or half page mode. Two current source transistors 127 and 129 are provided which charge capacitor 126 from a negative voltage source, −V. A transistor switch 125 is connected across capacitor 126 and controlled by horizontal sync pulse on lead 87 to discharge capacitor 126 during the horizontal retrace interval. The rate of charge of capacitor 126 is controlled by amplifier 120 via diodes 122 and 123. Width control potentiometer 121 connected to the negative voltage source thereby controls the conductivity of current source transistors 127 and 129 to vary the charging rate to permit width adjustment of the display. Transistor switch 124 is controlled by the logic level on lead 79 from CPU 100 which selects 32 line or 64 line operation. When 32 line operation is required, the horizontal scan time must be twice that for the 64 line mode. Therefore, transistor switch 124 serves to bias current source transistor 127 off such that only source 129 is effective in charging capacitor 126. Since the two current sources 127 and 129, when operative, provide equal currents, cutting off current source 127 results in a voltage ramp across capacitor 126 having half of its normal slope. However, the horizontal sync signal on lead 87 is occuring at half the full page rate and a full horizontal sweep will thus be produced. The voltage ramp appearing across capacitor 126 is capacitively coupled via coupling capacitor 61 to comparator network 60 and power amplifier 58 as indicated in FIG. 3. The capacitance coupling maintains a zero average current in the horizontal deflection winding 52. To ensure a linear deflection, the deflection current in horizontal deflection coil 52 from power amplifier 58 is sensed by feedback resistor 53 and compared differentially with the horizontal ramp voltage in comparator 60. Similarly, a variable dc voltage is also added by comparator 60 to provide control of horizontal linearity. This linearity control is required because of the large amount of energy stored in the horizontal deflection coil at the end of each scan and a necessity to rapidly reverse the current in the winding. Small losses occur in the flyback circuitry and the horizontal linearity adjustment permits compensation for these losses so as to produce an essentially perfect linear sweep for both full and half page modes.

Having hereinabove described the vertical magnetic deflection circuits and the horizontal magnetic deflection circuits, it may be seen that the electron beam is made to scan the face of CRT 14 from left to right at a scan rate to produce either 80 or 96 characters per line and that the beam is blanked during retrace after a scan is completed. The vertical magnetic deflection circuits have been seen to scan the electron beam from top to bottom at a much lower rate than the horizontal scan to thereby produce a raster of horizontal lines. The number of lines is selectable to be 32 or 64, with one extra horizontal line time allocated for vertical retrace for the 32 line mode, and two horizontal line times for vertical retrace for the 64 line mode. Also, as will be explained in more detail below, the raster lines generated by the vertical and horizontal magnetic deflection system will be blanked by reducing the intensity of the electron beam when no characters are being displayed. It may also now be understood that the X and Y electrostatic deflection plates are utilized to "write" cursive characters during each horizontal line scan. The Z axis or intensity of the electron beam in CRT 14 is controlled, as explained below, to control the intensity of the beam during character writing so as to produce the desired characters at the required brightness level. A more detailed description of the electrostatic deflection system and the video brightness control will now be presented.

Figure 7:
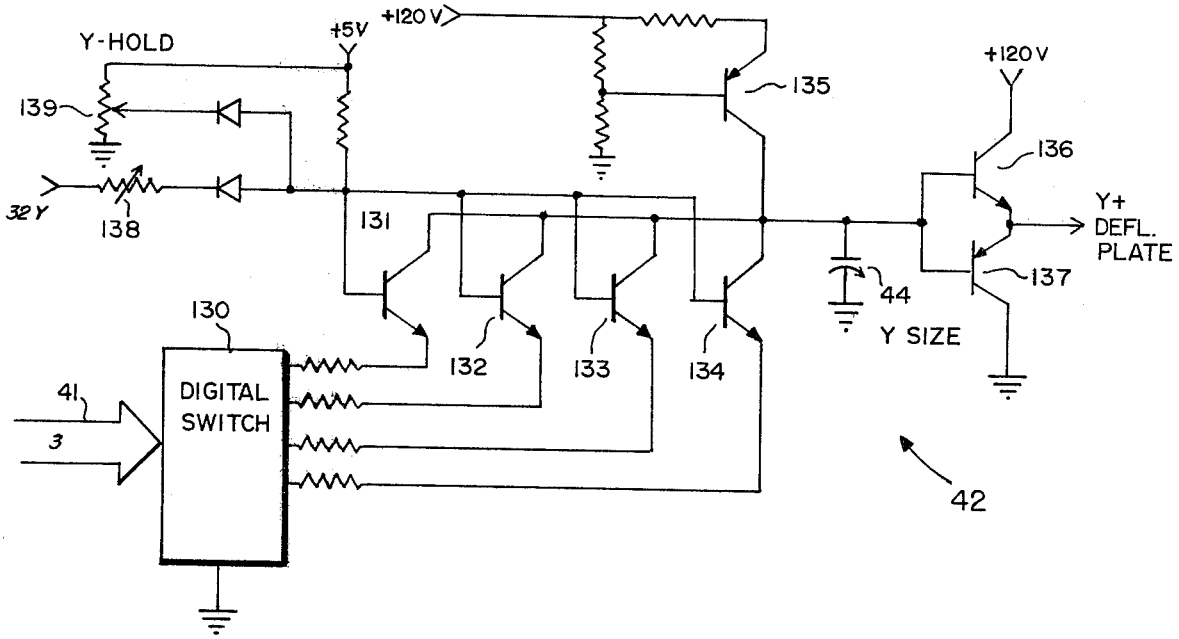
FIG. 7 is a simplified schematic diagram of the Y+ D/A converter of FIG. 3.

Referring now to FIG. 7, a simplified schematic of the Y+ electrostatic deflection plate digital-to-analog (D/A) converter 42 is shown. The output voltage to the Y+ deflection plate can be as high as 120 volts and the slew rate requirement can be as high as 135 volts per microsecond. Accordingly, a small, variable capacitor 44 is used as an integrating capacitor. As may be noted, capacitor 44 is variable and may be adjusted to conrol the size of the deflection along the Y axis. Capacitor 44 is charged from one positive current source 135 and four negative current sources 131 through 134. Three of the negative sources, 132, 133 and 134, are controlled by switch 130 which receives three bits of data via bus 41 from stroke data latch 32 of FIG. 3. As previously discussed, these three data bits define the magnitude and polarity of the Y− direction stroke by switching of the appropriate current sources 132, 133 and 134. The current from positive current source 135 is fixed while the magnitude of the four negative current sources is adjusted by a Y− hold potentiometer 139. Since the rate of change of voltage across capacitor 44 is proportional to the magnitude of the current flowing into the capacitor and inversely proportional to the magnitude of the capacitor, the size of the character can be controlled by adjusting capacitor 44. In the half page mode of operation of the system, it is necessary to produce characters having approximately twice the height of the full page character. Therefore the Y deflection magnitude must be increased by a factor of two. As may be recalled from the discussion of the horizontal sweep, the half page mode causes the horizontal line time to be twice that of the full page mode and current from the various current sources will flow into capacitor 44 for twice as long a time. Thus, no major change in the magnitudes of the currents is required for switching to the half page mode. However, the magnetic vertical deflection magnitude is twice as great during a character period and a corrective adjustment must be provided for compensation. Thus, potentiometer 138 is switched into the circuit by a logic level from CPU 100 calling for the 32 line or half page mode, and provides an adjustment to produce the correct character size for this mode.

To minimize the currents required from the current sources, the capacity of capacitor 44 is kept as small as practical. The voltage developed across capacitor 44 is coupled to the Y+ deflection plate by an output buffer consisting of emitter follower transistors 136 and 137 to minimize the effect of external capacitance and stray coupling between the X and Y deflection circuits.

Figure 8:
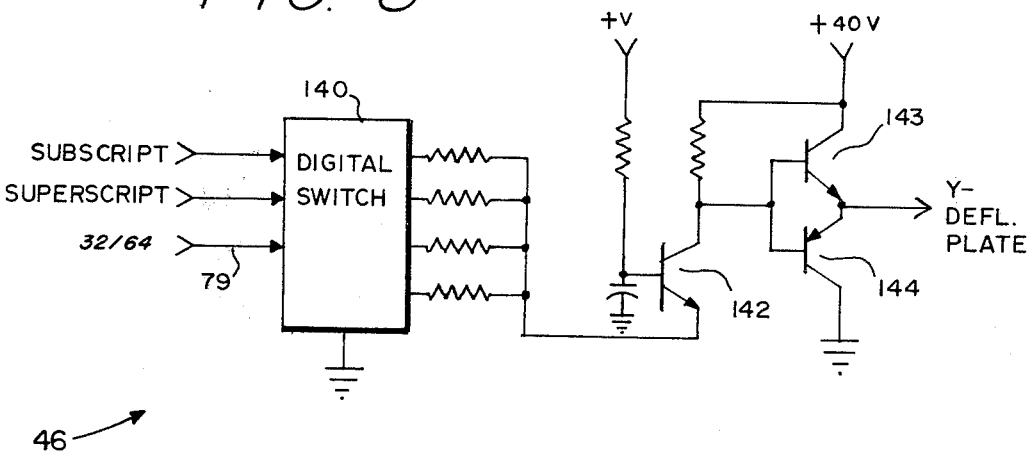
FIG. 8 is a simplified schematic diagram of the subscript/superscript digital analog converter of FIG. 3.

It is common to require subscripts and superscripts on the screen. Referring to FIG. 2, it may be seen that the character matrix 30 provides unused points above and below the position of a normal character. To produce a superscript or subscript, the lower or Y− deflection plate has appropriate dc potential applied thereto for the duration of writing of the character. FIG. 8 illustrates a simplified schematic of the superscript/subscript control circuit. This circuit is essentially a D/A converter 46 which has three digital inputs: subscript; superscript; and the 32/64 logic level. Accordingly, when a subscript, for example, is called for, the signal from CPU 100 appears on the subscript input to a logic switch 140 causing a positive potential to then be applied by transistor 142 via emitter follower transistors 143 and 144 to the Y− deflection plate during the 17th character stroke of the preceding character code, and causes this potential to be held during the entire following 16 character strokes. This action biases the electron beam downward such that the next character written will appear as a subscript. Similarly, when a superscript command is given the logic signal appearing on the superscript input to switch 140 causes transistor 142 to apply a more positive potential to the Y− deflection plate for the following character thereby raising that character to a superscript position. When the 32 line mode or half page display is selected by means of the appropriate logic level on lead 79 to switch 140 from CPU 100, causing switch 140 to control transistor 142 to produce either the subscript or superscript dc potential level shift on the Y− deflection plate having twice the magnitude as for the full page mode.

Figure 9:
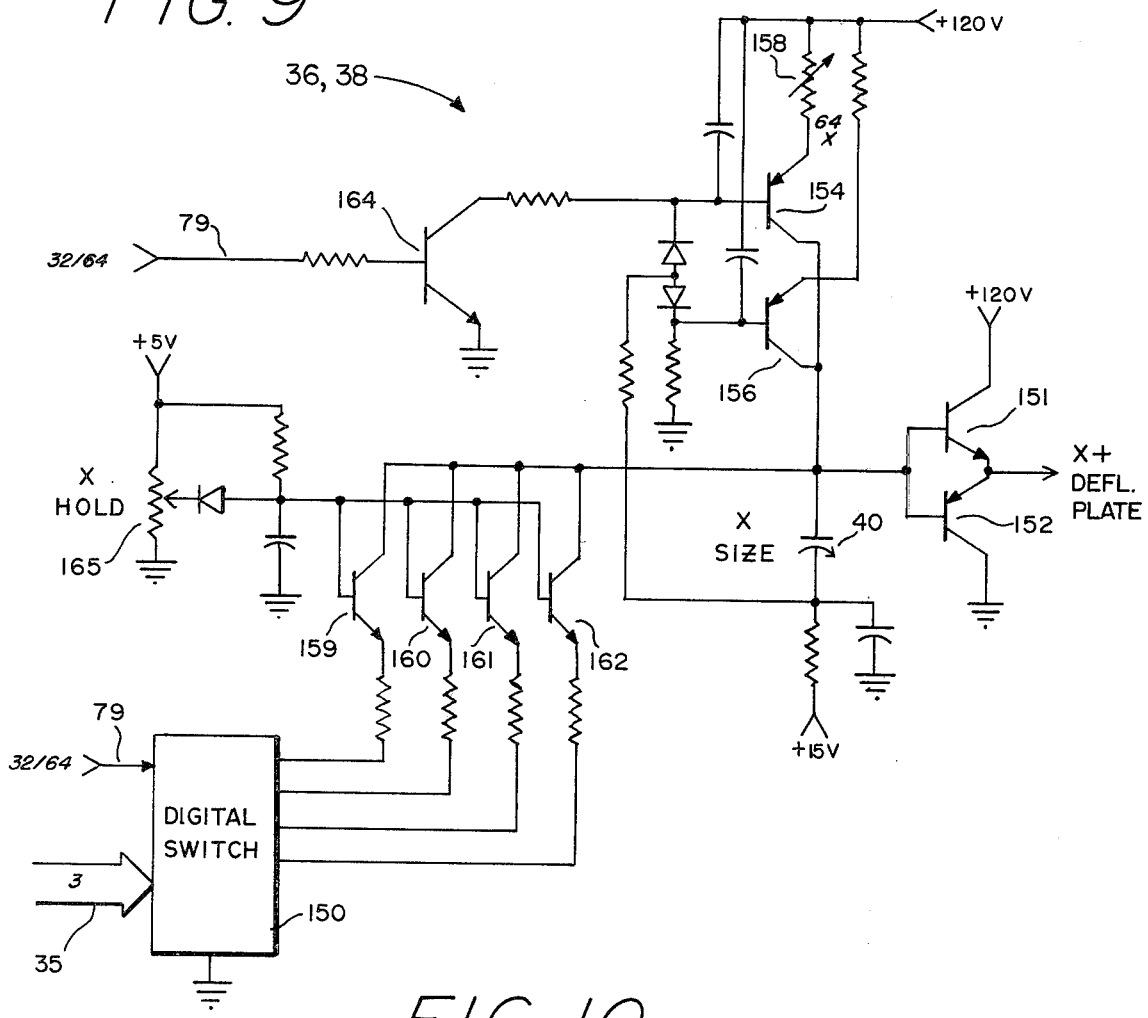
FIG. 9 is a simplified schematic diagram of the data switch and X+ D/A converter of FIG. 3.

Referring to FIG. 9, a simplified schematic diagram of the circuits for driving the X+ deflection plate is shown. The operation of the circuit is functionally similar to that of the Y deflection circuits previously described. The major difference lies in the fact that it is necessary to reduce the magnitude of all of the current sources by a factor of two when operation in the half page mode is required since twice as much time is available to write each character and the width of the characters must remain unchanged from full to half page mode. Therefore, the positive current source in FIG. 9 comprises two transistors 154 and 156 operating in parallel during the full page mode and only one operative in the half page mode. Four negative source transistors 159 through 162 are provided. A variable integrating capacitor 40 is used and, as in horizontal deflection circuits, is utilized to control the size of an X stroke. Each of the negative current source transistors 159 through 162 is controlled by digital switch 150 responsive to the three data bits from stroke data latch 32 (FIG. 3) appearing on bus 35, and the logic level on the full page mode, both positive current sources 156 and 154 are operative and the variations in the X deflection are controlled by switching of the four negative sources, 159 through 162. The magnitude of the negative current sources may be adjusted by means of X− hold potentiometer 165. When half page operation is selected by CPU 100, the appropriate logic level on lead 79 appears at digital switch 150 and at transistor switch 164. Transistor switch 164 is connected to positive source transistor 154 and serves to switch off that current source for half page operation in response to the "32" logic level. Similarly, digital switch 150 controls the negative current sources to produce half of their full page currents. Thus, the half voltage potentials produced on the X+ deflection plate operating for twice the time causes the width of the characters to remain unchanged when switching from full page mode to half page mode. To permit compensation for any slight errors that might occur between the full page and half page modes, positive current source 154 includes an independent adjustment by means of potentiometer 158 labeled "64X". Horizontal deflection plate X− is grounded.

Figure 10:
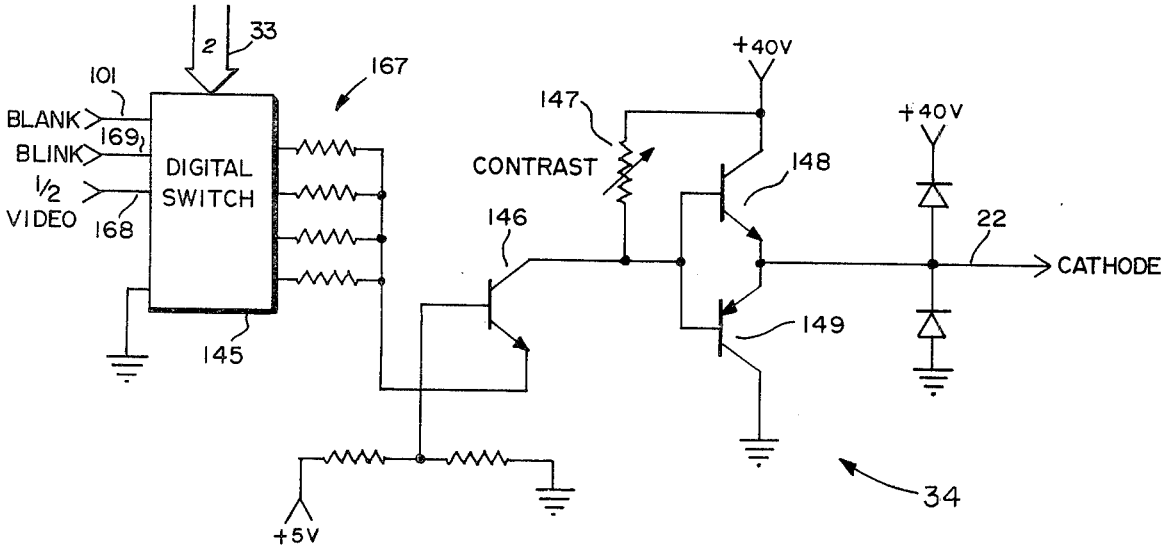
FIG. 10 is a simplified schematic diagram of the video D/A converter of FIG. 3.

As mentioned above, the brightness of the image on the screen of CRT 14 must be controlled for proper reproduction of the desired characters. FIG. 10 represents a simplified schematic diagram of the video output circuit 34 of FIG. 3. The output of this circuit is connected to cathode 20 of CRT 14 which requires a voltage swing of approximately 40 volts maximum. The circuit may be considered to be a digital to analog converter which receives digital information from CPU 100 and produces the necessary analog voltage swings of cathode 20. Two bits of digital information from stroke data latch 32 (FIG. 3) are supplied to digital switch 145 via bus 33. This information indicates the required beam intensity for each character stroke. As previously explained, the brightness must be increased during longer strokes, decreased during shorter strokes and must be cut off during strokes which are to be non-visible. Thus, each character may be controlled to have uniform brightness over the entire visible portions thereof. Four levels of brightness (off, low, medium, high) are achieved by controlling the output voltage of transistor 146 by switching of resistor array 167. The output of transistor 146 is coupled to cathode 20 by emitter followers 148 and 149 via lead 22. In addition to the brightness control from stroke data latch 32, logic level signals from CPU 100 also may control the beam intensity. It is necessary to blank the beam during horizontal and vertical retrace intervals; therefore, a logic signal on lead 101 from CPU 100 controls transistor 146 to cut off the beam. On occasions, it is desirable to blink a character or sequence of characters on the screen for alerting the operator or for other purposes. CPU 100 produces a video blink signal as a sequence of blanking pulses appearing on lead 169 to digital switch 145. This signal causes the beam to alternately cut off and return to normal intensity. On other occasions, it is desirable to display certain information on the screen at a lower than normal intensity. Thus, a one half video logic signal is generated by CPU 100 and connected to digital switch 145 via lead 168. During the time that this signal is present, switch 145 causes the display to be at approximately half the normal brightness. This procedure is particularly useful for generating lines used for forms or other background graphics. As may now be noted, the total number of required analog output levels is four for normal video intensity, four for half video intensity, and one for video blanking making a total of nine possibilities. The video signal levels are not changed when switching from half to full page displays.

Having now described in detail the novel cathode ray tube driver circuits of the present invention, it may be recognized that a system has been provided for use in a cursive writing type word processing display in which the vertical size of the characters may be expanded so as to display a half page for ease of reading and editing and relief of eyestrain on the part of the operator. The full page display is readily available to permit determination of the full page appearance. The system also allows a change in pitch of a character line which will produce wider characters for an 80 character per line mode and narrower characters for a 96 character per line mode. Means are also provided for producing subscript and superscript characters. Although certain specific circuits and selections of electronic components have been disclosed, it is to be considered that these are for exemplary purposes only and that the same functions may be provided by other components and circuit arrangements as will be obvious to those of ordinary skill in the art. Therefore, changes and modifications such as the use of integrated circuits in place of discrete components shown, and large scale integration in substitution for the indicated digital integrated circuits are considered to fall within the spirit and scope of the invention.

I claim:

1. In a cursive writing type word processing system having a cathode ray tube display using a magnetic deflection system to produce a scanning raster and an electrostatic deflection system to deflect the electron beam for writing cursive characters on the cathode ray tube screen from a sequence of linear strokes for each character, a central control processor unit having display and program memories for producing control commands, input devices connected to the control processor unit to initiate control commands, and a read only memory having a plurality of microprograms wherein each program is representative of a single character, the improvement comprising:

digital to analog converter means coupled to the read only memory for converting sequentially generated bytes from each microprogram read out from said read only memory, in response to a command from the control processor unit, into four independent analog signals, said digital to analog converter means having output lines connected to an X+ deflection electrode, a Y+ deflection electrode, a Y− deflection electrode, and a Z electrode of the cathode ray tube, said means including at least two X+ fixed current source means coupled to the X+ output line for generating a selectable magnitude potential having a first polarity on the X+ output line, said magnitude selected by a command from the control processor unit, X+ variable current source means coupled to the X+ output line for generating a variable magnitude potential having a second polarity on the X+ output line, the magnitude of the variable magnitude potential being representative of the digital data in each byte which defines the magnitude and direction of the X component of each stroke of the electron beam, the fixed and variable magnitude potentials being additively combined on the X+ output line, Y+ fixed current source means coupled to the Y+ output line for generating a fixed magnitude potential having a first polarity on the Y output line, Y+ variable current source means coupled to the Y+ output line for generating a variable magnitude potential having a second polarity on the Y+ output line, the variable magnitude potential being representative of the digital data in each byte which defines the magnitude and direction of the Y component of each stroke of the electron beam, the fixed and variable magnitude potentials being additively combined on the Y+ output line, Z variable current source means coupled to the Z output line for generating a potential on the Z output line having a magnitude representative of the digital data of each byte which defines the intensity of each stroke, Y− variable voltage means coupled to the Y− output line for generating a variable magnitude potential having a selectable polarity, said potential and polarity selected by a command from the central processing unit;

said digital to analog converter means adapted to thereby convert the sequentially generated bytes of each microprogram read out from the read only memory into four independent analog signals for controlling the position and intensity of the cathode ray tube electron beam to write a selected character on the screen of the cathode ray tube by connecting variable intensity, variable length linear strokes in patterns determined by each selected microprogram, and by biasing said Y− deflection electrode during writing of the selected character to form a superscript character, a subscript character or a normal character in accordance with a control processor unit command.

2. The improved system as defined in claim 1 in which said X+ fixed current source means includes a first and second X+ current source for producing a first potential on its said X+ output line, said first X+ fixed current source having switch means connected thereto, said switch means adapted to be responsive to a preselected logic level from the central processing unit to disconnect said first X+ fixed current source from said X+ output line thereby reducing the potential on said X+ output line to approximately one half of its first value.

3. The improved system as defined in claim 1 in which said Z variable current source means includes control means for selectively controlling the intensity of the electron beam response to commands from the control processing unit.

4. The improved system as defined in claim 3 in which said control means includes means for selecting full intensity, half intensity, zero intensity, and a periodically varying intensity.

5. The improved system as defined in claim 1 in which said Z variable current source means is controllable by a byte from a microprogram to generate a potential representative of any one of four levels of intensity of a stroke.

6. In a cursive writing type word processing system having a cathode ray tube display using a magnetic deflection system to produce a scanning raster and an electrostatic deflection system to deflect the electron beam for writing cursive characters on the cathode ray screen, a central control processor unit having display and program memories for producing control commands, and input devices connected to the control processor unit to initiate control commands, the improvement producing a full page display or a partial page display comprising:

a first character pitch oscillator for producing a pulse stream representative of a first preselected number of characters per line to be written on the cathode ray tube screen;

divider means connected to said oscillator for dividing the frequency of the pulse stream by an integer;

switch means connected to receive the pulse stream from said oscillator and the divided pulse stream from said divider, said switch means having an input for receiving a display size command from said control processor unit, said command controlling the selection of the oscillator pulse stream or the divided pulse stream;

binary counter means for receiving the output from said switch means, said counter adapted to count the incoming pulses and to produce a character clock output when said counter reaches a number equal to the number of cursive strokes required for writing one character and character space, said binary counter also producing a four bit binary output representative of the count for use by the cursive writing system;

line and page timing means connected to said binary counter to receive said character clock, and connected to the central processing unit to receive a logic level representative of a selected number of lines for a full page scan raster or of a fraction of such selected number for a partial scan raster, such fraction determined by said divider means dividing integer, said line and page timing means responsive to said character clock to produce a line sync pulse when the selected number of characters per line has been completed for each line, said latter means also producing a horizontal control pulse during each line, and a page synchronization pulse and vertical control pulse when the selected number of lines per page have been completed; and horizontal magnetic scanning means for producing a horizontal scan and retrace of the electron beam and vertical magnetic scanning means for producing a vertical scan and retrace of the electron beam, said horizontal scanning means connected to said line and page timing means for receiving the horizontal control pulses therefrom, said vertical scanning means connected to said line and page timing means for receiving the vertical control pulses therefrom, said horizontal scanning means also connected to receive a first logic level signal from said central processing unit representative of a full page horizontal scan or a second logic level signal representative of partial page horizontal scan.

7. The improved system of claim 6 which further comprises:

second character pitch oscillator for producing a pulse stream representative of a second preselected number of characters per line to be written on the cathode ray screen;

clock switch means connected to receive the pulse streams from said first character pitch oscillator and said second character pitch oscillator, and having an output connected to said divider and to said switch means, said clock switch means responsive to a pitch logic command from the central processing unit to output the pulse stream from said first character pitch oscillator or the pulse stream from said second character pitch oscillator; and in which said line and page timing means is connected to receive said pitch logic command from the central processing unit to thereby produce said line sync pulse after completion of the number of character times per line selected by the pitch logic command.

8. The improved system as defined in claim 7 in which said first character pitch oscillator produces 80 characters per line, and said second character pitch oscillator produces 96 characters per line.

9. The improved system as defined in claim 7 in which said line and page timing means produces 64 lines for a full page display and in which said divider means divides said outputted oscillator pulse stream frequency by two thereby dividing the character clock rate by two, and in which said line and page timing means is responsive to the divided character clock rate and the partial page logic command from the control processor unit to produce said page sync pulse for a page having 32 lines.

10. The improved system as defined in claim 9 in which the electrostatic deflection system is responsive to the partial page logic command to produce characters having twice the height and the same width as characters produced in response to the full page logic command.

11. The improved system of claim 7 in which said line and page timing means comprises:

a first dual binary counter connected to receive said character clock;

a first read only memory means connected to receive the output of said first dual binary counter and the pitch logic command, said latter means having a microprogram stored therein for producing the line sync signal and the horizontal scanning control signal from the character clock generated from said first character pitch oscillator, and a second microprogram for producing said line sync signal and said horizontal scan control signal from said second character pitch oscillator responsive to the pitch logic command from the central processing unit;

a second dual binary counter connected to receive an input from said first read only memory means; and a second read only memory means connected to receive the output from said second dual binary counter and to receive the full or partial page logic level from the central processing unit for producing the page sync signal and the vertical scanning control signal.

* * * * *